US008721808B2

(12) United States Patent
Yamanaka et al.

(10) Patent No.: US 8,721,808 B2
(45) Date of Patent: May 13, 2014

(54) FERRITE SYSTEM HEAT-RESISTANT CAST STEEL AND EXHAUST SYSTEM COMPONENT

(75) Inventors: Daisuke Yamanaka, Toyota (JP); Zhong-zhi Zhang, Toyota (JP)

(73) Assignee: Aisin Takaoka Co., Ltd., Aichi (JP)

( * ) Notice: Subject to any disclaimer, the term of this patent is extended or adjusted under 35 U.S.C. 154(b) by 0 days.

(21) Appl. No.: 13/058,951

(22) PCT Filed: Feb. 8, 2010

(86) PCT No.: PCT/JP2010/052132

§ 371 (c)(1),
(2), (4) Date: Feb. 14, 2011

(87) PCT Pub. No.: WO2010/125841

PCT Pub. Date: Nov. 4, 2010

(65) Prior Publication Data

US 2011/0132499 A1 Jun. 9, 2011

(30) Foreign Application Priority Data

Apr. 27, 2009 (JP) ..... 2009-107431

(51) Int. Cl.
*C22C 38/26* (2006.01)
*C22C 38/46* (2006.01)
*C22C 38/48* (2006.01)

(52) U.S. Cl.
USPC ..... 148/326; 148/325; 420/42; 420/70

(58) Field of Classification Search
CPC ..... C22C 38/26; C22C 38/48; C22C 38/46
USPC ..... 148/325, 326; 420/42, 70
See application file for complete search history.

(56) References Cited

U.S. PATENT DOCUMENTS

| | | | | |
|---|---|---|---|---|
| 4,986,857 | A * | 1/1991 | Hewitt | 148/602 |
| 5,152,850 | A * | 10/1992 | Takahashi et al. | 148/325 |
| 2007/0215252 | A1 * | 9/2007 | Takabayashi et al. | 148/325 |

FOREIGN PATENT DOCUMENTS

| | | | |
|---|---|---|---|
| CN | 1942598 | | 4/2007 |
| EP | 0635581 | A1 * | 1/1995 |
| JP | 01-159355 | | 6/1989 |
| JP | 05-320830 | | 12/1993 |
| JP | 07-034204 | | 2/1995 |
| JP | H08-188856 | | 7/1996 |
| JP | 2001279391 | | 10/2001 |
| JP | 2007-254885 | | 10/2007 |

OTHER PUBLICATIONS

Machine-English translation of Japanese patent No. 08-188856, Genma Kiwa et al., Jul. 23, 1996.*
Preliminary Rejection issued by the Chinese Intellectual Property Office on Oct. 24, 2012.
The Extended European Search Report issued by the European Patent Office on Jul. 18, 2013.

* cited by examiner

*Primary Examiner* — Deborah Yee
(74) *Attorney, Agent, or Firm* — IP & T Group LLP

(57) ABSTRACT

The ferrite system heat-resistant cast steel and the exhaust system component are provided, which are inexpensive and are able to improve the reliability by largely improving the toughness under normal temperature and thermal fatigue performance. The ferrite system heat-resistant cast steel includes composition structure comprised, percent by mass, of 0.1% to 0.4% carbon, 0.5% to 2.0% silicon, 0.2% to 1.2% manganese, 0.3% or less phosphorus, 0.01% to 0.4% sulfur, 14.0% to 21.0% chrome, 0.05% to 0.6% niobium, 0.01% to 0.8% aluminum, 0.15% to 2.3% nickel, residual iron and inevitable impurities.

7 Claims, 14 Drawing Sheets with 1000-fold magnification

10μm

Reflected Electron Image (aqua regia Etching)

Exhaust Manifold

Turbine Housing

Turbine Housing Integrated Exhaust Manifold

FERRITE SYSTEM HEAT-RESISTANT CAST STEEL AND EXHAUST SYSTEM COMPONENT

This application is a national stage application of PCT/JP2010/052132 filed on Feb. 8, 2010, which claims priority of Japanese patent application number 2009-107431 filed on Apr. 27, 2009. The disclosure of each of the foregoing applications is incorporated herein by reference in its entirety.

TECHNOLOGICAL FIELD

This invention relates to a ferrite heat-resistant cast steel and an exhaust system component formed thereby.

BACKGROUND ART

Recent years, the operating temperature of components used in automobiles and industrial equipments has been more and more rising and accordingly, higher heat-resistant cast steels are now being more used. Especially, with the strengthening of exhaust gas regulations, the exhaust gas temperature is becoming higher and higher in the automobiles and industrial equipments or the like and a cast steel with high heat-resistance performance is used for an exhaust system component such as for example, an exhaust manifold of the engine used under the temperature of 900° C. or more.

As the high heat-resistant cast steel, austenitic system heat-resistant cast steel and ferrite system heat-resistant cast steel are exampled. As to the austenitic system heat-resistant cast steel, although the heat-resistance performance is excellent, the material cost is very high due to the high content of expensive nickel and the cutting performance is not so good. On the other hand, as to the ferrite system heat-resistant cast steel, the cost is relatively inexpensive compared to the austenitic system heat-resistant cast steel. However, the heat-resistance performance is not sufficient, considering the recent requirements. Further, the normal temperature toughness of the ferrite system heat-resistant cast steel is not necessarily good and use of the ferrite system heat-resistant cast steel still needs some work in order to gain the high reliability.

In Patent Document 1 (JP 07 (1995)-34204 A), a ferrite heat-resistant cast steel including 0.06% to 0.2% of sulfur to improve cutting performance is disclosed. However, this is still not sufficient.

DISCLOSURE OF THE INVENTION

Problems to be Solved

This invention was made considering the above situational problems and the object of the invention is to provide a ferrite system heat-resistant cast steel having a ferrite system component which demonstrates a high strength, secures elongation performance under normal temperature, largely improves the toughness performance leading to improvement in thermal fatigue resistant performance, and which is capable of improving reliability and is yet inexpensive and an exhaust system component using thereof.

Means for Solving the Problems

The ferrite system heat-resistant cast steel according to the first invention includes a ferrite system composition structure comprised, percent by mass, of 0.10% to 0.40% carbon, 0.5% to 2.0% silicon, 0.2% to 1.2% manganese, 0.3% or less phosphorus, 0.01% to 0.4% sulfur, 14.0% to 21.0% chrome, 0.05% to 0.6% niobium, 0.01% to 0.8% aluminum, 0.15% to 2.3% nickel, residual iron and inevitable impurities.

The ferrite system heat-resistant cast steel according to the second invention includes a ferrite system composition structure comprised, percent by mass, of 0.10% to 0.40% carbon, 0.5% to 2.0% silicon, 0.2% to 1.2% manganese, 0.3% or less phosphorus, 0.01% to 0.4% sulfur, 14.0% to 21.0% chrome, 0.01% to 0.5% vanadium, 0.05% to 0.6% niobium, 0.01% to 0.8% aluminum, 0.15% to 2.3% nickel, residual iron and inevitable impurities.

The Effects of the Invention

According to the invention, a ferrite system heat-resistant cast steel and the exhaust system component can be provided which exhibits a high strength, secures elongation characteristics under normal temperature, and improves the reliability by largely improving the toughness performance. Further, since the content of nickel can be decreased compared to that of the austenitic system heat-resistant cast steel, cost of the ferrite system heat-resistant cast steel can be reduced.

BRIEF EXPLANATION OF ATTACHED DRAWINGS

PREFERRED EMBODIMENTS OF THE INVENTION

Figure 1:
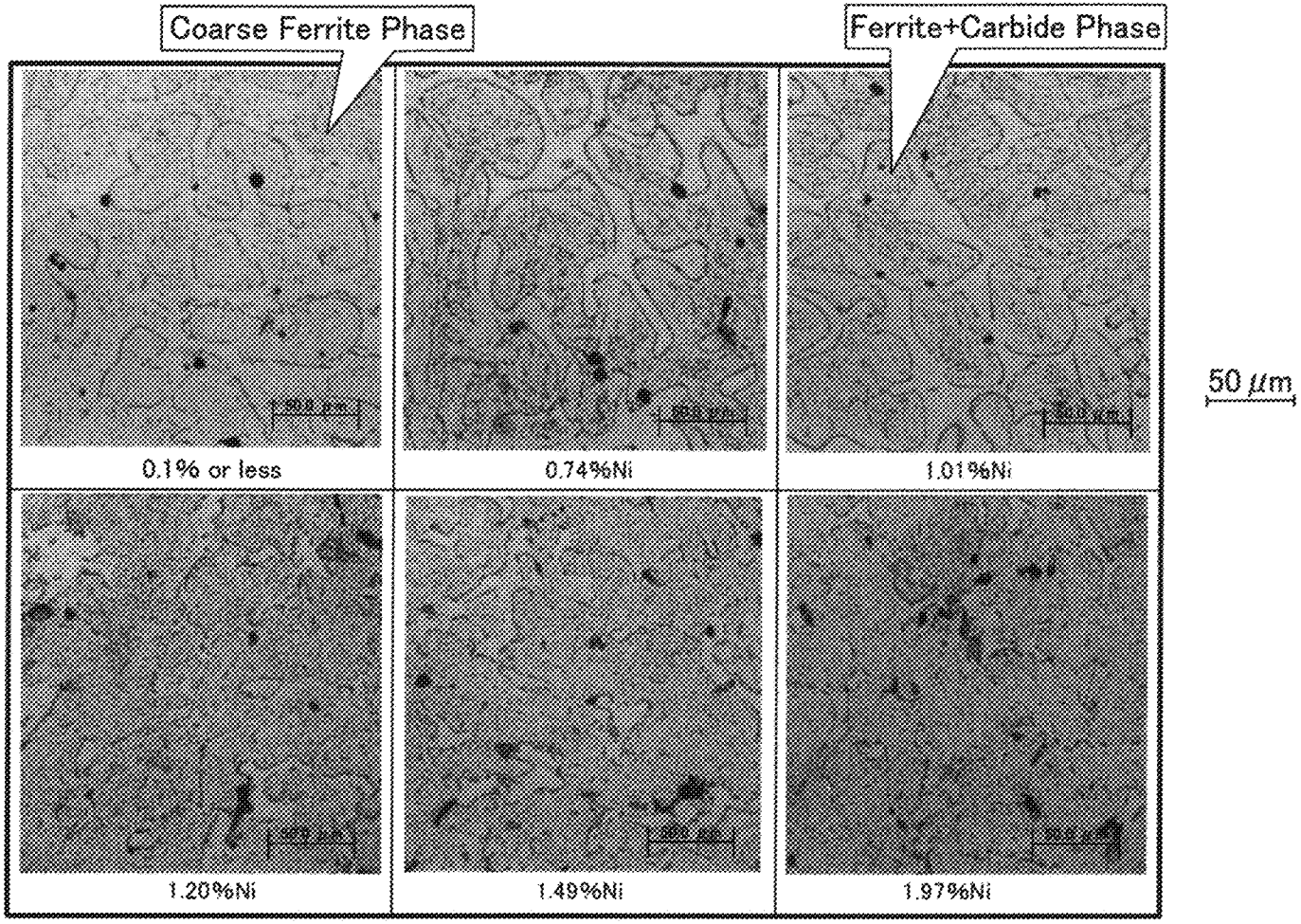
FIG. 1 is a view showing the composition structure in which the nickel content was varied, observed by an optical microscope.

The reasons for limiting the composition will be explained hereinafter.

Carbon: 0.10% to 0.40%:

Carbon improves casting performance (flow property), high temperature strength and heat-resistant performance. The casting performance (flow property) is particularly required for thin wall products, such as for example, the exhaust system components. However, if the content of carbon is excessively large, the carbide is generated excessively and the structure becomes fragile. The upper limit value of carbon content is exampled as 0.39%, 0.38% or 0.37% depending on the requested nature. The lower limit value of the carbon content, combined with the above upper limit value, is exampled as 0.12%, 0.14% or 0.16%, also depending on the requested nature. Further, as the range of the carbon content, 0.15% to 0.40%, 0.17% to 0.35% and 0.20% to 0.30% are exampled.

Silicon: 0.5% to 2.0%:

Silicon improves oxidation resistance. If the content is low this oxidation resistance performance drops and if the content is excessively high, the toughness performance decreases. The upper limit value of silicon content is exampled as 1.9%, 1.8%, 1.7% or 1.6% depending on the requested nature. The lower limit value of the silicon content, combined with the above upper limit value, is exampled as 0.55%, 0.60%, or 0.70%, also depending on the requested nature. Further, as the range of the silicon content, 0.70% to 1.80%, 0.90% to 1.50% and 1.00% to 1.30% are exampled.

Manganese: 0.2% to 1.2%:

Manganese is an element which demonstrates de-oxidation effects in the manufacturing process. The upper limit value of manganese content is exampled as 1.10%, 1.00%, 0.90%, 0.80% or 0.70% depending on the requested nature. The lower limit value of the manganese content, combined with the above upper limit value, is exampled as 0.25%, 0.30%, or 0.40%, also depending on the requested nature. Further, as the range of the manganese content, 0.30% to 1.00%, 0.40% to 0.90% and 0.50% to 0.80% are exampled.

Phosphorus: 0.3% or less:

Phosphorus is an element which affects the cutting performance. The upper limit value of phosphorus content is exampled as 0.25%, 0.20%, 0.15% or 0.10% depending on the requested nature. The lower limit value of the phosphorus content, combined with the above upper limit value, is exampled as 0.002%, 0.005%, 0.01% or 0.02%, also depending on the requested nature.

Sulfur: 0.01% to 0.4%:

Sulfur is an element which improves the cutting performance. Although when the sulfur content is excessively high, the cuffing performance can be improved, but the heat-resistance performance may drop. The upper limit value of sulfur content is exampled as 0.38%, 0.35%, 0.30%, 0.28%, 0.25% or 0.20% depending on the requested nature. The lower limit value of the sulfur content, combined with the above upper limit value, is exampled as 0.02%, 0.03%, 0.04% or 0.05%, also depending on the requested nature. Further, as the range of the sulfur content, 0.03% to 0.25%, 0.05% to 0.20% and 0.06% to 0.18% are exampled.

Chrome: 14.0% to 21.0%:

Chrome is the main element of the ferrite system heat-resistant cast steel which transforms the composition structure to a ferrite composition structure and enters into ferrite solid solution. If the content is small, the ferrite structure as the high heat resistant base composition cannot be sufficiently secured. If the content is excessively high, the structure becomes fragile. The upper limit value of chrome content is exampled as 20.0%, 19.0%, 18.0% or 17.0% depending on the requested nature. The lower limit value of the chrome content, combined with the above upper limit value, is exampled as 14.5%, 15.0% or 15.5%, also depending on the requested nature. Further, as the range of the chrome content, 14.5% to 20.5%, 15.0% to 20.0% and 15.5% to 18.0% are exampled.

Niobium: 0.05% to 0.6%:

Niobium is an element which forms stable niobium carbide and improves the high temperature strength. The upper limit value of the niobium content is exampled as 0.55%, 0.50%, or 0.45% depending on the requested nature. The lower limit value of the niobium content, combined with the above upper limit value, is exampled as 0.07% or 0.08%, also depending on the requested nature. Further, as the range of the niobium content, 0.07% to 0.05%, 0.10% to 0.50% and 0.12% to 0.45% are exampled Aluminum: 0.01% to 0.8%:

Aluminum is an element which is added for de-oxidation and degasifying in the manufacturing process. The upper limit value of aluminum content is exampled as 0.70%, 0.60% or 0.50% depending on the requested nature. The lower limit value of the aluminum content, combined with the above upper limit value, is exampled as 0.02%, 0.04% or 0.06%, also depending on the requested nature. Further, as the range of the aluminum content, 0.01% to 0.55%, 0.02% to 0.45% and 0.03% to 0.35% are exampled.

Nickel: 0.15% to 2.3%:

If the content is low, the elongation performance under room temperature drops and the strength and hardness also drop at the same time. If the content is excessively high, the entire or approximately the entire base composition becomes the carbide mixed phase in the ferrite crystal grain and although the hardness becomes high, the elongation performance under room temperature drops. Considering these characteristics, the upper limit value of nickel content is exampled as 2.2%, 2.1%, 2.0%, 1.9%, 1.8% or 1.7% and further exampled as 1.6% or 1.5%, depending on the requested nature. The lower limit value of the nickel content, combined with the above upper limit value, is exampled as 0.2%, 0.3%, 0.4% or 0.5% also depending on the requested nature. Further, as the range of the nickel content, 0.20% to 2.10%, 0.30% to 2.10%, 0.25% to 1.90% and 0.30% to 1.80% are exampled.

Vanadium: 0.01% to 0.5%:

Vanadium has the role to improve the strength under the high temperature. Vanadium forms the carbide. If the content is excessively high, coarse carbides are generated and the elongation performance under normal temperature and at the same time thermal fatigue performance may drop. Further, the cost becomes high. The upper limit value of vanadium content is exampled as 0.47%, 0.45%, 0.40%, 0.30%, 0.20%, 0.15% or 0.10%, depending on the requested nature. The lower limit value of the vanadium content, combined with the above upper limit value, is exampled as 0.015%, 0.020% or 0.025% also depending on the requested nature. Further, as the range of the vanadium content, 0.01% to 0.50%, 0.02% to 0.45% and 0.03% to 0.35% are exampled. Considering the improvement in elongation performance and thermal fatigue performance and cost reduction, vanadium may not be included in the ferrite system heat-resistant cast steel according to the invention.

The composition structure of the ferrite system heat resistant cast steel according to the invention is preferably formed to be in coexistence between the first phase formed by the ferrite and the second phase in which the carbide is mixed in the ferrite crystal grains. In the area where the area ratio of the second phase exceeds 50%, the hardness and the strength increase as well as the elongation performance, as the area ratio in the second phase increases. However, when the area ratio in the second phase further increases, it has the tendency that the elongation decreases although the hardness and the strength still further increase (See performance line A2 in FIG. 5). For this reason, assuming that the entire visible field of the microscope is 100%, it is preferable to set the area ratio of the second phase to be equal to or more than 50% or 60%. Particularly, it is preferable to set the area ratio of the second phase to be in between 50% and 80%. It is preferable to set the area ratio of the second phase to be in between 55% and 75%.

The elongation performance can be improved, improving the tensile strength at the same time according to the ferrite system heat-resistant cast steel of the present invention. It is preferable for the ferrite system heat-resistant cast steel to have the elongation of 4% or more and the tensile strength of 400 MPa or more. It is further preferable for the ferrite system heat-resistant cast steel to have the elongation of 6% or more and the tensile strength of 500 MPa or more. It is still preferable for the ferrite system heat-resistant cast steel to have the elongation of 7% or more and the tensile strength of 700 MPa or more. There are some limits for a generally structured steel material to achieve improvements in both the tensile strength and the elongation performance.

It is preferable for the ferrite system heat-resistant cast steel to conduct heat treatment to cool down to the temperature of 700° C. after being heated and held under the temperature of between 800° C. and 970° C. The reason why the heating and holding are preferably conducted is to improve the cutting performance and to remove the casting residual stress by reducing the hardness performance. As to the time for heating and holding, 1 to 10 hours, 2 to 7 hours and 3 to 5 hours are exampled, but this time depends on the type of alloy element, content of alloy element or size of cast steel. It is preferable to cool the furnace or to conduct air cooling upon cooling down operation to 700° C. The above explained ferrite system heat-resistant cast steel can be applied to heat-resistant components used in the vehicles and industrial equipments. Particularly, it is adaptable to the exhaust system components used for the vehicles and the industrial equipments.

EXAMPLE 1

According to the Example 1, the steel material and the alloy material were melted in the high frequency blast furnace (weight: 500 kg) under the atmospheric environment. The temperature for melting was 1700° C. The molten metal was injected into Y-block sand mold (green sand casting) (under the injection temperature of 1600° C.) and solidified to form a solidified body. After this process, the solidified body was heated and held for 3.5 hours at the temperature of 930° C. under the atmospheric environment and then as the heat treatment process, the solidified body was cooled in the furnace (furnace cooling) down to the temperature of 700° C. or less (actually, at 500° C.) under the atmospheric environment. The cuffing performance can be improved by this heat treatment process. Thereafter, test pieces for tensile testing (JIS No. 4 test piece) were formed by cutting the solidified body. The ferrite system heat-resistant cast steel according to the present invention was formed. Instead of furnace cooling, air cooling may be used.

The materials for this invention have the composition (analytical values) as shown in Table 1, Nos. 1 to 8. The residuals are substantially the irons. The test pieces Nos. 1 to 3 are a series of group including a small amount of vanadium with 0.05% or less and the test pieces Nos. 4 to 8 are another series of group including no vanadium.

The invention materials numbered as test piece Nos. 1 to 3 include nickel in the ferrite system heat-resistant cast steel and include vanadium. As to the test piece No. 1, the mass ratio of nickel relative to vanadium (nickel %/vanadium %) is 0.45/0.04, which is approximately equal to 11.3. In the test piece No. 2, the ratio of nickel relative to vanadium is 0.74/0.029, which is approximately equal to 25.5. In the test piece No. 3, the ratio of nickel relative to vanadium is 1.01/0.028, which is approximately equal to 36.1. Accordingly, the test piece including vanadium, the ratio of nickel relative to vanadium is exampled as in the range of 1.2 to 100, 2 to 80, 4 to 50 or 4 to 30.

The invention materials numbered as test piece Nos. 4 to 8 include nickel in the ferrite system heat-resistant cast steel and do not include vanadium therein. Accordingly, the test pieces Nos. 4 to 8 do not include vanadium (0% vanadium) and accordingly, the value of the ratio of nickel relative to vanadium is indefinite (∞).

TABLE 1

| Invention Material | | | | | | | | | | | | | |
|---|---|---|---|---|---|---|---|---|---|---|---|---|---|
| | No. | C % | Si % | Mn % | P % | S % | Cr % | V % | Nb % | Al % | Ni % | Tensile strength MPa | Elongation % |
| Test Piece | 1 | 0.19 | 1.31 | 0.57 | 0.019 | 0.110 | 16.7 | 0.04 | 0.20 | 0.12 | 0.45 | 621 | 6.7 |
| Test Piece | 2 | 0.20 | 1.25 | 0.58 | 0.016 | 0.106 | 16.5 | 0.029 | 0.19 | 0.16 | 0.74 | 669 | 6.8 |
| Test Piece | 3 | 0.19 | 1.25 | 0.58 | 0.017 | 0.101 | 16.6 | 0.028 | 0.20 | 0.14 | 1.01 | 696 | 8.1 |
| Test Piece | 4 | 0.25 | 1.32 | 0.59 | 0.017 | 0.104 | 16.5 | — | 0.19 | 0.13 | 1.20 | 762 | 6.6 |
| Test Piece | 5 | 0.21 | 1.33 | 0.57 | 0.018 | 0.099 | 16.4 | — | 0.19 | 0.12 | 1.49 | 794 | 4.6 |
| Test Piece | 6 | 0.22 | 1.24 | 0.62 | 0.020 | 0.099 | 17.0 | — | 0.19 | 0.14 | 1.75 | 820 | 4.0 |
| Test Piece | 7 | 0.20 | 1.27 | 0.59 | 0.016 | 0.096 | 16.8 | — | 0.20 | 0.13 | 1.97 | 865 | 3.0 |
| Test Piece | 8 | 0.19 | 1.26 | 0.61 | 0.017 | 0.110 | 17.1 | — | 0.19 | 0.12 | 2.21 | 880 | 1.9 |

FIG. 1 shows a photographic view of a composition structure (Nita) corrosion) taken by an optical microscope. As shown in FIG. 1, the structures of test pieces including less than 1% nickel, 0.74% nickel (test piece No. 2), 1.01% nickel (test piece No. 3), 1.20% nickel (test piece No. 4), 1.49% nickel (test piece No. 5) and 1.97% nickel (test piece No. 7) were photographed.

In the test piece containing less than 0.1% nickel, the first phase (ferrite phase with no carbide) formed by the ferrite was of sea state and coarsened and the second phase (phase of ferrite and carbide) in which the carbide was mixed in the ferrite crystal grain was of island state. Assuming that the visible field of the microscope is 100%, the second phase, which is of island state occupied smaller areas, less than 50% in the area ratio.

In the test piece (No. 2) with 0.74% nickel, the area ratio of the first phase in sea state formed by the ferrite decreased and the area ratio of the second phase in island state (ferrite and carbide faze) mixed with the carbide in the ferrite crystal grain increased. Assuming that the visible field by the microscope is 100%, the area ratio of the second phase was presumed to be 60% or more. Further, in the test piece (No. 4)

with nickel increased to 1.20%, the area ratio of the sea and the island was completely reversed and the area ratio of the first phase formed by the ferrite decreased considerably and the area ratio of the second phase (ferrite and carbide phase) mixed with the carbide in the crystal grain of the ferrite was presumed to be increased to 70% or more. Still further, in the test piece (No. 7) with further increased nickel of 1.97%, the area ratio of the first phase formed by the ferrite further decreased and the area ratio of the second phase (ferrite and carbide phase) mixed with the carbide in the crystal grain of the ferrite was presumed to be further increased to 90% or more.

Figure 2:
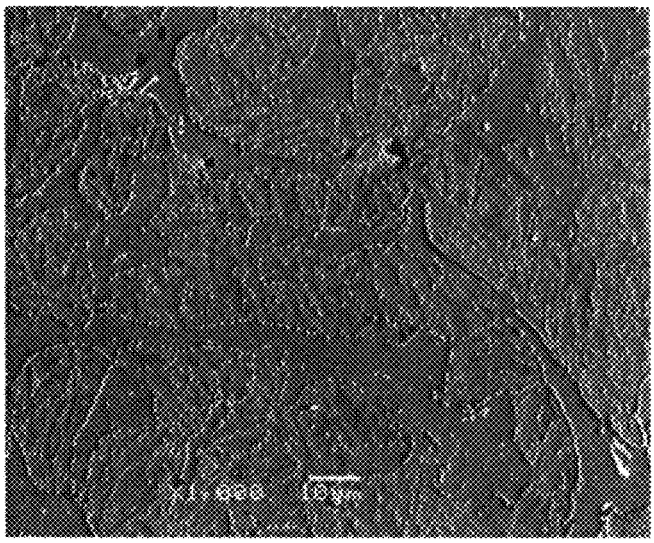
FIG. 2 is a view showing the composition structure observed by a scanning electron microscope (SEM)
Figure 3:
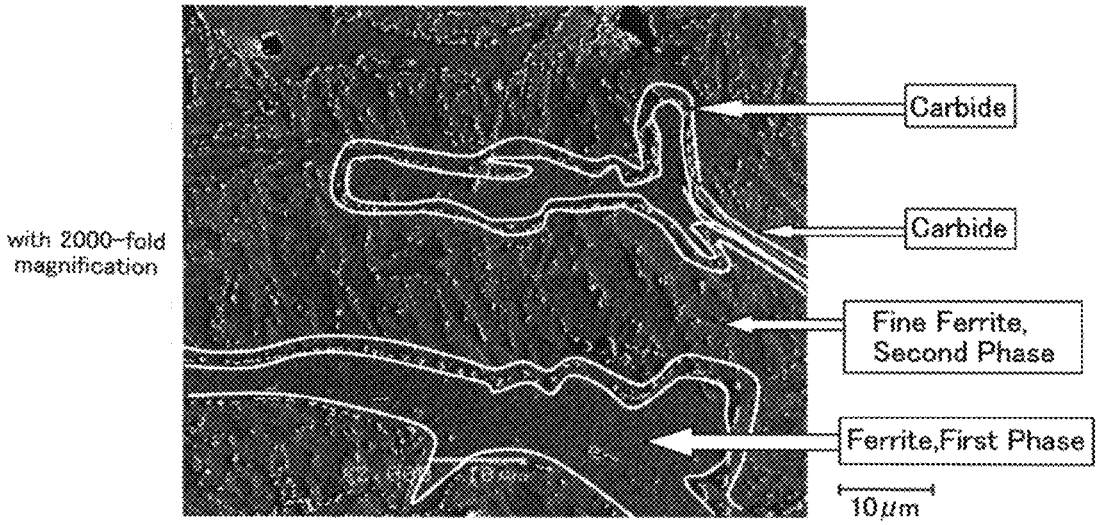
FIG. 3 is a view showing the composition structure observed by the scanning electron microscope (SEM), but changing the magnification ratio thereof.
Figure 4:
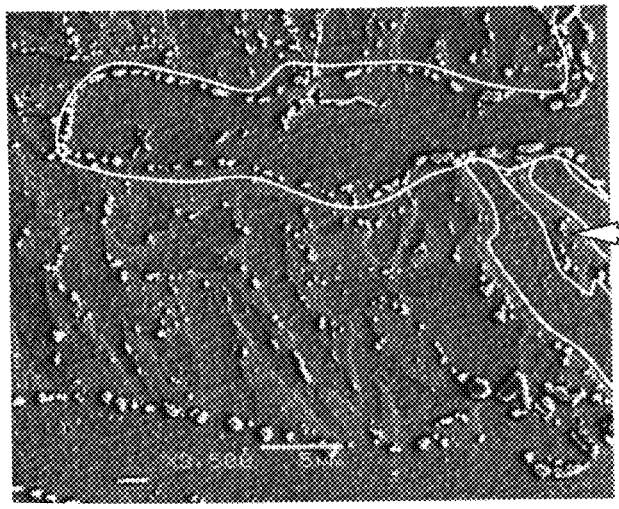
FIG. 4 is a view showing the composition structure observed by the scanning electron microscope (SEM), further changing the magnification ratio thereof.

FIGS. 2 to 4 show the photographs of the structure taken by the scanning electron microscope (SEM) with different magnifications. In this case, the No. 3 test piece with 1.01% nickel content was exampled. As shown in FIGS. 2 to 4, the first phase (the ferrite phase, carbide not included) formed by the ferrite existed. Further, the second phase (the phase, in which the carbide has been dispersed in the crystal ferrite, fine ferrite phase) mixed with the carbide in the crystal grain of the ferrite exists. In the boundary between the first phase and the second phase, carbide with very fine grain state has been generated. The plurality of carbides existing in the boundary separately existed with an interval with one another. The size of carbide of micro particles existing in the boundary between the first phase and the second phase and the size of the carbide existing in the ferrite crystals forming the second phase are very small with less than 1 μm. These micro particle carbides are difficult to be the starting point of cracks and are considered to contribute to the improvements in tensile strength, elongation performance and thermal fatigue strength.

It is noted here that the micro-Vickers hardness of the first phase formed by the ferrite was MHV (0.1N) 254. The micro-Vickers hardness of the second phase (the phase in which the carbide has been dispersed in the crystal ferrite) mixed with the carbide in the crystal grain of the ferrite was MHV (0.1N) 240. Thus, since the first phase included more nickel, the hardness thereof was higher than that of the second phase.

Figure 5:
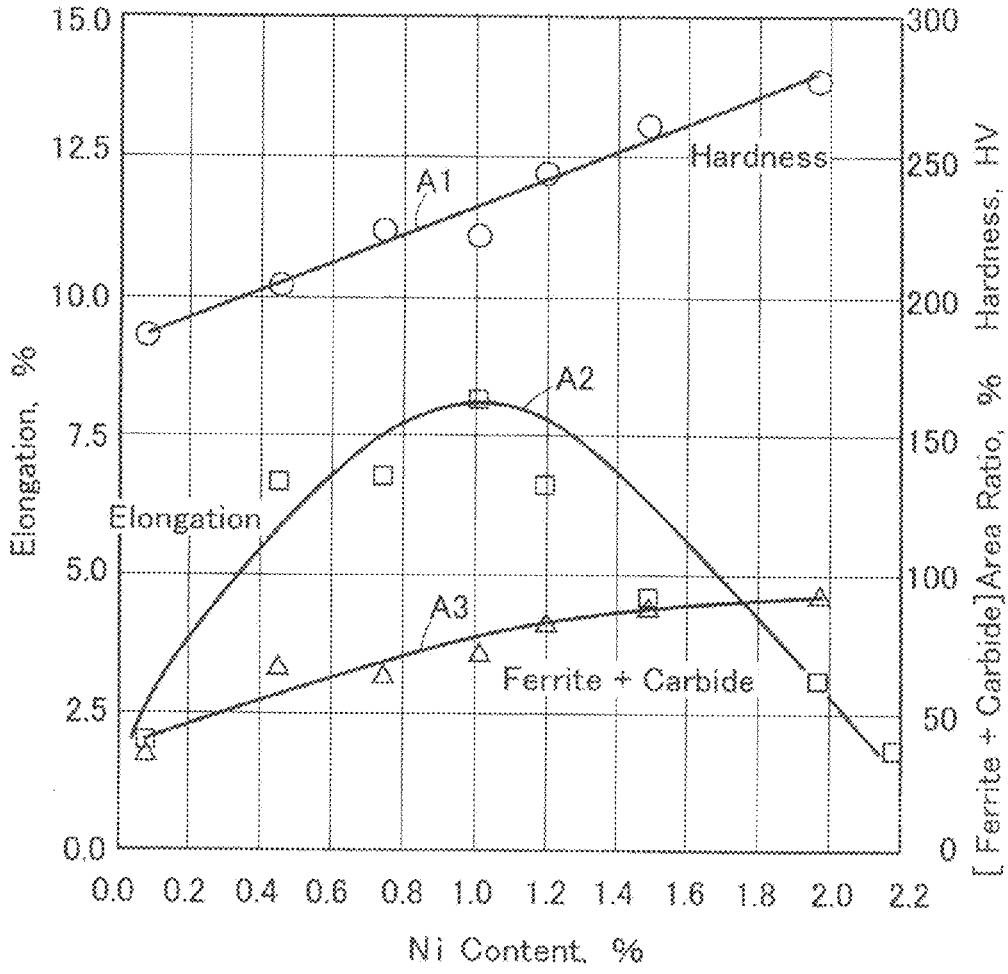
FIG. 5 is a graph showing the relationship between the nickel content and elongation performance, area ratio of second phase and the hardness.

The relationship between the hardness (Hv) and elongation performance and the nickel content was measured for each test piece (Nos. 1 through 8) corresponding to the respective invention materials indicated in the Table 1. Further, the relationship between the area ratio relative to the entire visible field of the second phase (ferrite+carbide), the phase in which the carbide has been dispersed in the crystal ferrite and the nickel content was measured. FIG. 5 shows the test result. The horizontal axis in FIG. 5 indicates the nickel content. The left side vertical axis in FIG. 5 indicates the elongation measured by the tensile test (elongation under normal temperature). The lower part of the right side vertical axis in FIG. 5 indicates the area ratio of the second phase (ferrite+carbide) assuming that the entire visible field is 100%. The upper part of the right side vertical axis in FIG. 5 indicates the hardness (hardness at normal temperature).

As shown with the performance line A1 in FIG. 5, the performance characteristic that the hardness gradually increases as the nickel content increases was confirmed. The hardness corresponds to the tensile strength. Further, as shown with the performance line A2, another performance characteristic that the elongation gradually increases as the nickel content increases until the nickel content reaches around 1.0%, and thereafter, the elongation gradually decreases as the nickel content increases was confirmed. As indicated by the performance line A2 in FIG. 5, in the relationship between the nickel content and the elongation performance, a peak-shaped critical meaning was confirmed. As indicated by the performance line A3 in FIG. 5, the performance characteristic that the area ratio of the second phase increases as the nickel content increases was confirmed.

On the condition that the composition is defined as the composition associated with claims 1 and 2, it is preferable to set the content range of nickel to be 0.1% to 2.0% in order to achieve the elongation performance of 2.5% or more, according to the performance line A2 in FIG. 5. It is further preferable to set the content range of nickel to be 0.13% to 1.9% in order to achieve the elongation performance of 3.0% or more. It is still preferable to set the content range of nickel to be 0.18% to 1.83% in order to achieve the elongation performance of 3.5% or more.

According to the performance line A2 shown in FIG. 5, it is preferable to set the content range of nickel to be 0.21% to 1.80% in order to achieve the elongation performance of 4.0% or more. It is further preferable to set the content range of nickel to be 0.28% to 1.72% in order to achieve the elongation performance of 4.5% or more. It is still further preferable to set the content range of nickel to be 0.38% to 1.65% in order to achieve the elongation performance of 5.0% or more. It is preferable again to set the content range of nickel to be 0.41% to 1.60% in order to achieve the elongation performance of 5.5% or more. It is further preferable to set the content range of nickel to be 0.50% to 1.50% in order to achieve the elongation performance of 6.0% or more. It is preferable to o set the content range of nickel to be 0.62% to 1.40% in order to achieve the elongation performance of 6.5% or more.

Here, it is noted that if in case of application that the tensile strength (hardness) should be increased, even sacrificing the improvement in the elongation to some extent, the nickel content can be more increased than that (nickel content: 0.90 to 1.10) in the vicinity of the peak of the performance line A2. To achieve this, the range of the nickel content can be set between 1.10% and 2.00%, 1.20% and 2.00%, 1.30% and 2.00% or 1.4% and 2.00%.

Further, if in case of application that the hardness should be decreased to obtain a higher cutting performance, even sacrificing the improvement in the elongation to some extent, the nickel content can be decreased than that (nickel content: 0.90 to 1.10) in the vicinity of the peak of the performance line A2. To achieve this, the range of the nickel content can be set between 0.20% and 0.90%, 0.20% and 0.80% or 0.20% and 0.70%.

TABLE 2

| Conventional Material | | | | | | | | | | | |
|---|---|---|---|---|---|---|---|---|---|---|---|
| | No. | C % | Si % | Mn % | P % | S % | Cr % | V % | Nb % | Tensile strength MPa | Elongation % |
| Test Piece | 1A | 0.15 | 1.18 | 0.58 | 0.024 | 0.089 | 16.6 | 0.64 | 0.24 | 526 | 3.5% |
| Test Piece | 2A | 0.15 | 1.10 | 0.48 | 0.023 | 0.106 | 16.7 | 0.54 | 0.23 | 475 | 4.0% |
| Test Piece | 3A | 0.17 | 1.12 | 0.46 | 0.023 | 0.100 | 16.7 | 0.58 | 0.20 | 450 | 1.8% |

TABLE 2-continued

| Conventional Material | | | | | | | | | | | |
|---|---|---|---|---|---|---|---|---|---|---|---|
| | No. | C % | Si % | Mn % | P % | S % | Cr % | V % | Nb % | Tensile strength MPa | Elongation % |
| Test Piece | 4A | 0.15 | 1.14 | 0.49 | 0.023 | 0.104 | 17.0 | 0.60 | 0.17 | 447 | 2.5% |
| Test Piece | 5A | 0.15 | 1.12 | 0.49 | 0.023 | 0.103 | 16.8 | 0.60 | 0.16 | 402 | 2.2% |
| Test Piece | 6A | 0.19 | 1.18 | 0.45 | 0.023 | 0.098 | 17.8 | 0.62 | 0.18 | 477 | 3.2% |
| Test Piece | 7A | 0.20 | 1.05 | 0.42 | 0.022 | 0.104 | 16.7 | 0.60 | 0.17 | 500 | 2.9% |
| Test Piece | 8A | 0.18 | 1.16 | 0.65 | 0.024 | 0.098 | 16.9 | 0.57 | 0.22 | 517 | 3.5% |
| Test Piece | 9A | 0.17 | 1.13 | 0.46 | 0.024 | 0.098 | 16.8 | 0.57 | 0.21 | 492 | 3.6% |
| Test Piece | 10A | 0.18 | 1.12 | 0.47 | 0.024 | 0.098 | 17.4 | 0.62 | 0.20 | 463 | 2.2% |
| Test Piece | 11A | 0.16 | 1.09 | 0.46 | 0.024 | 0.093 | 16.9 | 0.60 | 0.21 | 492 | 1.3% |
| Test Piece | 12A | 0.17 | 1.46 | 0.53 | 0.025 | 0.102 | 16.6 | 0.58 | 0.20 | 474 | 3.4% |
| Test Piece | 13A | 0.15 | 1.16 | 0.49 | 0.025 | 0.114 | 17.0 | 0.62 | 0.23 | 552 | 1.6% |
| Test Piece | 14A | 0.17 | 1.33 | 0.45 | 0.024 | 0.099 | 16.9 | 0.59 | 0.19 | 435 | 0.7% |
| Test Piece | 15A | 0.16 | 1.08 | 0.50 | 0.024 | 0.103 | 16.5 | 0.59 | 0.20 | 440 | 1.30% |

The Table 2 shows the composition, the tensile strength and the elongation performance of each test piece of Nos. 1A through 15A of the conventional material. The conventional material is the ferrite system heat-resistant cast steel. In the test pieces Nos. 1A through 15A, no nickel is included. Further, the vanadium content is 0.54% or more and is relatively high. As understood from the Table 2, the elongation performance decreases as the tensile strength becomes high in the test pieces Nos. 1A through 15A made by the conventional material.

EXAMPLE 2

The test pieces of the ferrite system heat-resistant cast steel of the Example 2 corresponding to the invention material were formed according to the similar process to the Example 1. The tensile test was conducted for the test pieces under the normal temperature. The test pieces of the comparative examples 1 through 4 were formed basically in accordance with the similar process and tested similarly. The compositions thereof are shown in Table 3. In the comparative example 1, the carbon content is 1.18%, which is excessively high compared to that of the composition of the invention material, the niobium content is 5.80%, which is excessively high compared to that of the composition of the invention material and further, the tungsten content is 4.28%, which is a large amount.

TABLE 3

| | C % | Si % | Mn % | P % | S % | Cr % | Nb % | N % | V % | Ni % | W % |
|---|---|---|---|---|---|---|---|---|---|---|---|
| Comparative example 1 | 1.18 | 1.24 | 0.77 | — | — | 25 | 5.80 | 0.12 | — | 1.75 | 4.28 |
| Comparative example 2 | 0.42 | 0.58 | 0.54 | — | — | 19 | 2.35 | 0.05 | — | 0.72 | — |
| Comparative example 3 | 0.20 | 1.22 | 0.59 | 0.03 | 0.11 | 17 | 0.20 | — | 0.63 | 0.11 | — |
| Comparative example 1 | 0.14 | 1.43 | 0.57 | 0.01 | 0.10 | 16 | 0.14 | — | 0.60 | 1.00 | — |
| Example 2 | 0.19 | 1.11 | 0.52 | 0.03 | 0.10 | 17 | 0.20 | — | 0.10 | 0.94 | — |

In the comparative example 2, the carbon content is 0.42%, which is excessively high compared to the composition of the present invention material, niobium content is 2.35%, which is excessively high compared to the composition of the present invention material. In the comparative example 3, the vanadium content is 0.63%, which is excessively high compared to the composition of the present invention material. In the comparative example 4, the vanadium content is 0.60%, which is excessively high compared to the composition of the present invention material. In the comparative examples 3 and 4, vanadium content in each composition is high and excessive vanadium carbides are formed.

Figure 6:
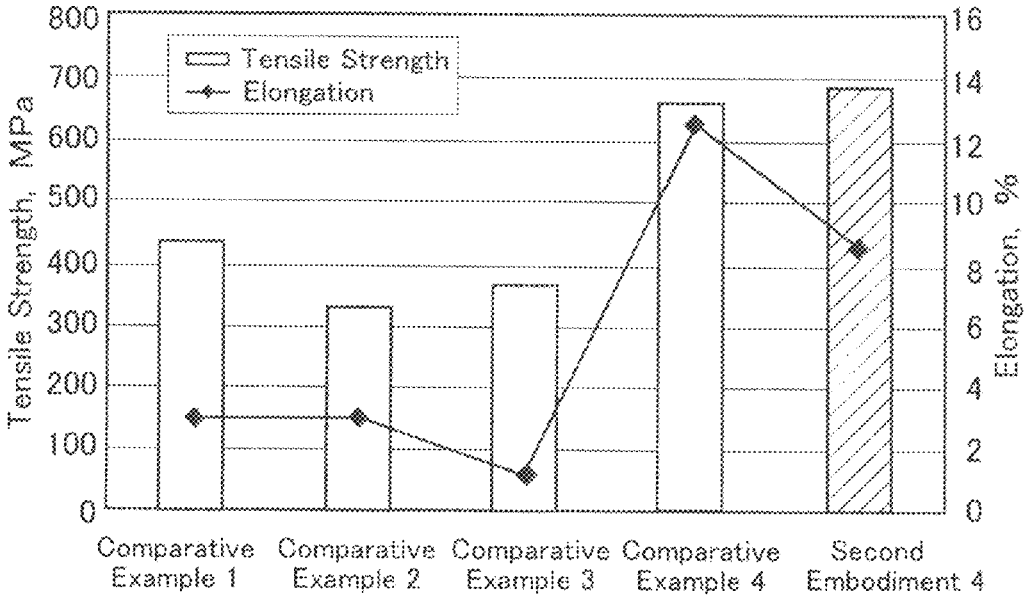
FIG. 6 is a graph showing date of tensile strength and the elongation performance.

FIG. 6 shows the test result (tensile strength test and elongation performance test). As shown in FIG. 6, although the tensile strength in the comparative example 1 was about 440 MPa, the elongation performance was only 3%, which is low relative to the tensile strength value. Although the tensile strength in the comparative example 2 was about 320 MPa, the elongation performance was only 3%, which is low relative to the tensile strength value. Although the tensile strength in the comparative example 3 was about 380 MPa, the elongation performance was only 1.6%, which is low relative to the tensile strength value. Except vanadium, the composition of the comparative example 4 resembles the composition of the invention and although the tensile strength was 660 MPa which is a large amount, the elongation performance was 12.2%, which was also high.

Compared to the above, as shown in FIG. 6, the example 2 of the invention material includes expensive vanadium, the content of which is only one sixth (116) of the vanadium content in the comparative example 4. Although the vanadium content was decreased, both tensile strength and the elongation performance were favorable. Particularly, in spite of the high tensile strength of 680 MPa, the elongation performance was also high of 8.2%. Thus, according to the ferrite system invention material, the tensile strength can be improved with keeping the high elongation performance.

EXAMPLE 3

According to the similar process with the Example 1, the test pieces for thermal fatigue test were formed by the ferrite system heat-resistant cast steel of the invention material. The test pieces are round bar shaped and the diameter at the parallel portion of each test piece was set to be 10 mm and the length of the parallel portion was set to be 25 mm. The outer surface of the parallel portion was surface-finished by machining. The test pieces were tested by the thermal fatigue cycle test. With the constraint ratio of 50%, the test piece was constrained, the test was conducted with the operating temperature raised from 200° C. to 850° C. with four and half (4.5) minutes and dropped from 850° C. to 200° C. with four and half (4.5) minutes. This process was defined as one operation cycle and compression stress and tensile stress were applied on the test piece in an axial direction thereof.

The composition of the test piece (resembling the test piece of Example 2 in Table 3) according to the ferrite system heat-resistant cast steel of the invention conducted by this test was formed, percent by mass, by 0.19% carbon, 1.11% silicon, 0.52% manganese, 0.030% phosphorus, 0.100% sulfur, 17.0% chrome, 0.20% niobium, 0.11% aluminum, 0.94% nickel, a residual iron and inevitable impurities and has a ferrite system structure under the normal temperature region.

The test pieces of austenite system heat-resistant cast steel in comparative examples and the conventional materials were similarly tested. The composition of the test piece according to the austenite system heat-resistant cast steel of the comparative examples was formed by 0.31% carbon, 2.24% silicon, 1.12% manganese, 0.032% phosphorus, 0.070% sulfur, 17.2% chrome, 0.52% niobium, 2.41% molybdenum, 14.8% nickel, a residual iron and inevitable impurities, percent by mass, and has an austenite system structure under the normal temperature region. The composition of the test piece according to the conventional material was formed by 0.20% carbon, 1.22% silicon, 0.59% manganese, 0.030% phosphorus, 0.110% sulfur, 17.0% chrome, 0.52%, 0.10% nickel, 0.63% vanadium, a residual iron and inevitable impurities, percent by mass and has a ferrite system structure under the normal temperature region. Although the test piece of the conventional material resembles the invention material in composition, large amount (0.63%) of vanadium was included and niobium was not included.

Figure 7:
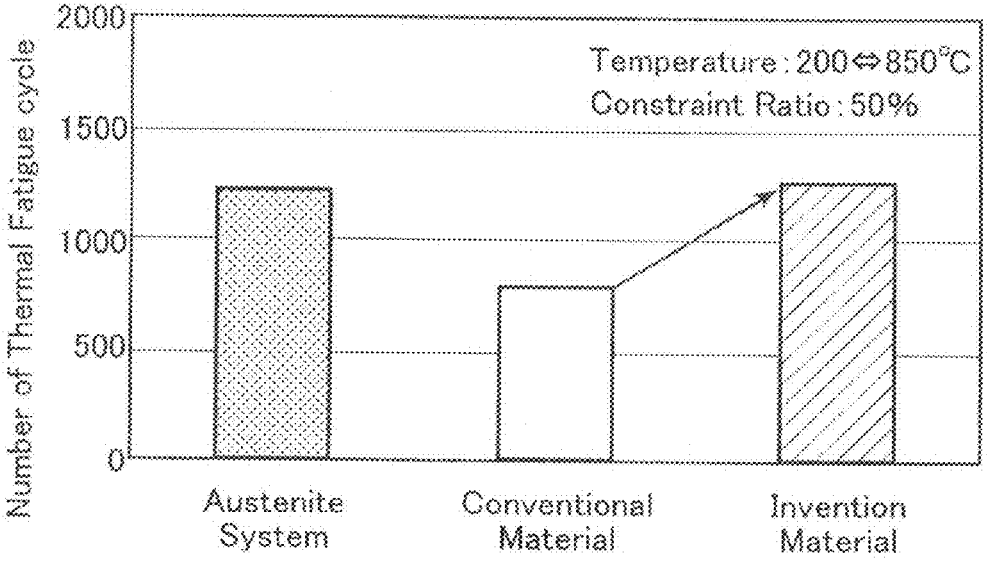
FIG. 7 is a graph showing the result of thermal fatigue cycle test.

FIG. 7 shows the result of the thermal fatigue cycle test. As shown in FIG. 7, according to the austenite system heat-resistant cast steel of the comparative example, the number of cycle at which first cracks were generated was about 1250, which indicates an excellent result. According to the conventional material, the number of cycle at which cracks were generated was about 800, which indicates a bad result. Compared to these results, according to the invention material, in spite of the low content of nickel compared to that of the austenite system heat-resistant cast steel, the cycle number at which cracks were generated was about 1300 and the invention material provided a comparable result with the austenite system heat-resistant cast steel of the comparative example.

Figure 8:
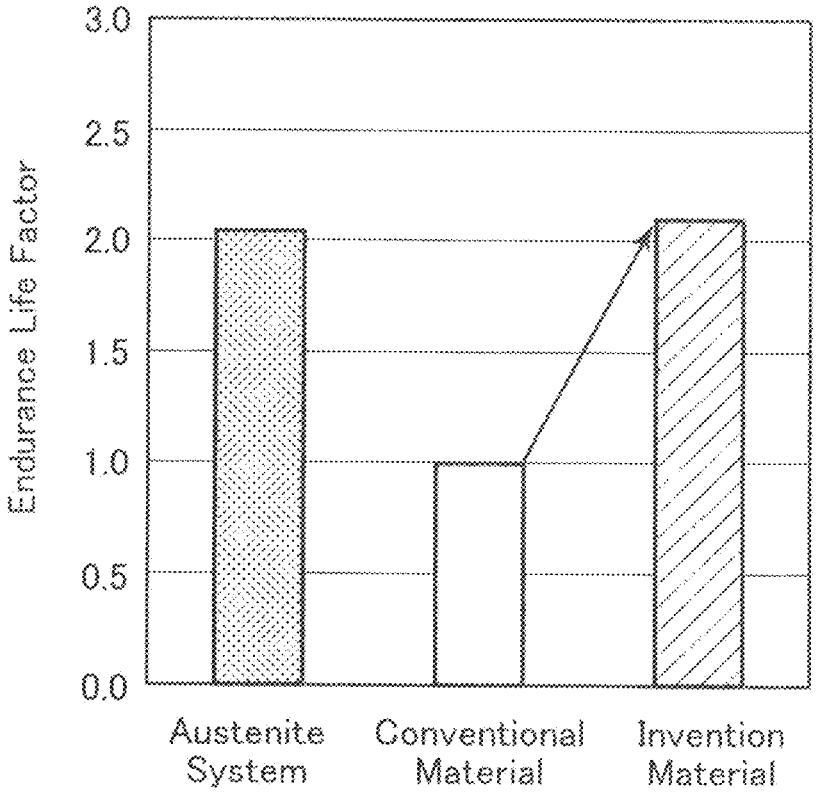
FIG. 8 is a graph showing an endurance life factor.
Figure 14:
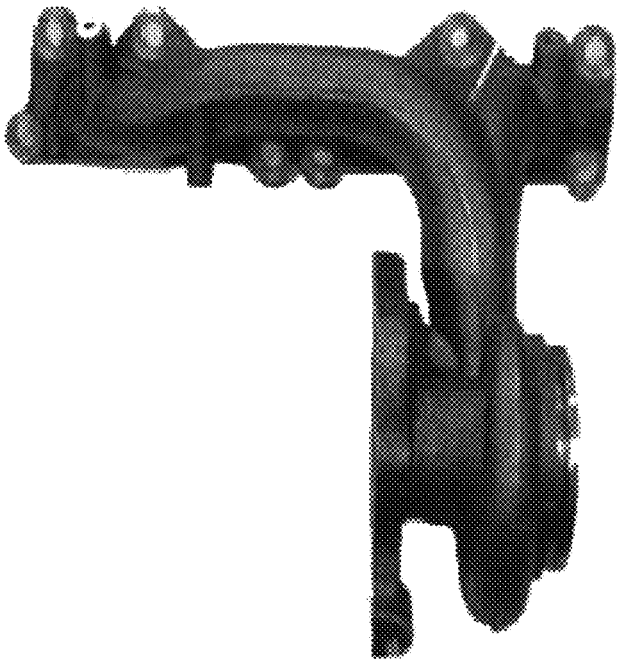
FIG. 14 is a photographic view showing an exhaust manifold integrated with the turbine housing.

FIG. 8 shows the endurance life factor of the later explained turbine housing integrated exhaust manifold (See FIG. 14). The endurance life factor was obtained as follows.

In detail, the thermal fatigue test was conducted to the turbine housing integrated exhaust manifold (See FIG. 14) and assuming that the number of cycle the conventional material, at which crack is generated is preset as endurance life factor 1, each endurance life factor of the austenite system heat-resistant cast steel and the invention material can be obtained from the respective cycle numbers at which the cracks were generated. It is noted here that the test was conducted under the turbine housing integrated exhaust manifold (see FIG. 14) being fixed, using burner, the operating temperature was raised from 150° C. to 850° C. with five (5) minutes and was dropped from 850° C. to 150° C. with seven (7) minutes by compulsive cooling. This is defined as one cycle and the temperature raising and dropping cycles were repeatedly conducted.

As shown in FIG. 8, the endurance life factor of the austenite heat-resistant cast steel of the comparative example was about 2.1, which is excellent in performance. The endurance life factor of the conventional material was 1.0, which was not good. Compared to these results, the endurance life factor of the invention material was about 2.1, which provided a comparable result with the austenite system heat-resistant cast steel of the comparative example.

Here, the austenite system heat-resistant cast steel of the comparative example is excellent in thermal fatigue performance. However, since this includes large amount of expensive elements, such as, 14.8% nickel, 2.41% molybdenum, the cost becomes high.

Compared to this, according to the invention material of example 3, the thermal fatigue performance and the endurance life were excellent. However, the chrome content was 17.0% which was the same level content (chrome: 17.2%) with the austenite system heat-resistant cast steel of the comparative example. However, the nickel content of the invention material was low with about 0.94% and comparing with the nickel content (nickel: 1.48%) of austenite system heat-resistant cast steel, the content of 0.94% was very low. Further, the invention material of the example 3 does not include molybdenum and further does not include vanadium, which is, costwise, advantageous. Thus, the invention material is low in cost and excellent in thermal fatigue performance and the endurance life performance. Further, according to the test piece of the conventional material, although the composition resembles that of the invention material, the vanadium content is high with 0.63 which leads to an excessive generation of carbide including vanadium and the size of the generated carbide is big and the thermal fatigue and endurance life are not sufficiently performed.

Figure 9:
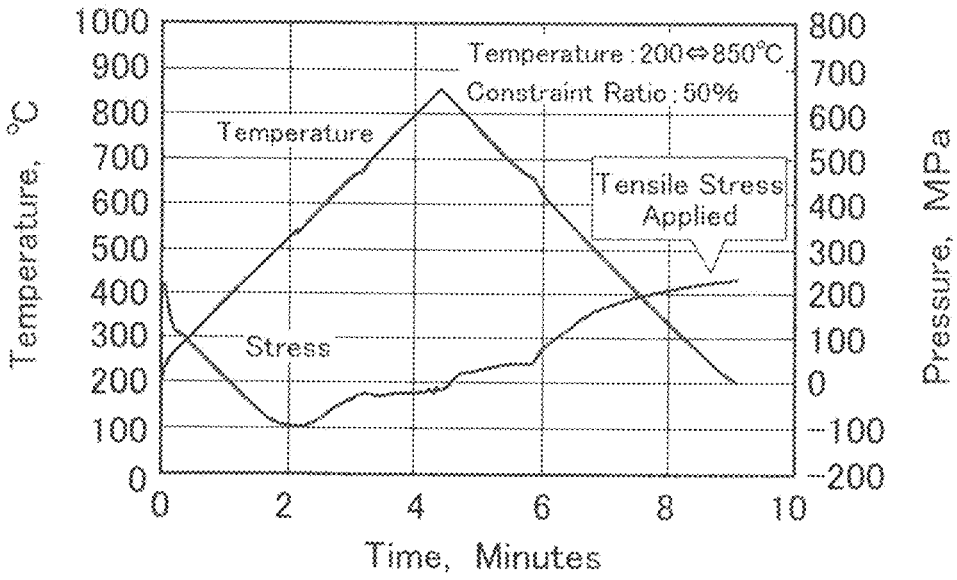
FIG. 9 is a graph showing an example of a condition of stress exerting on a test piece in the thermal fatigue cycle test.

FIG. 9 shows the changes of performance characteristic in the case that the above thermal fatigue cycle test was conducted to the conventional material. As shown in FIG. 9, under the test piece being kept with the constraint ratio of 50%, the temperature of the test piece was raised from 200° C. to 850° C. with 4.5 minutes and dropped from 850° C. to 150° C. with 4.5 minutes. This is defined as one cycle and applied the compression stress and the tensile stress on the test piece in an axial direction thereof. The horizontal axis in FIG. 9 designates time and left side vertical axis designates the temperature of the test piece and the right side vertical axis designates stress generated on the test piece. The region where the stress is less than 0 MPa, the compression stress is applied on the test piece and the region where the stress exceeds 0 MPa in the positive direction the tensile stress is applied on the test piece. As understood from FIG. 9, when the temperature of the test piece drops due to cooling, a large tensile stress is applied on the test piece. Accordingly, the material having a low elongation performance is considered to have a low thermal fatigue resistance.

Figure 10:
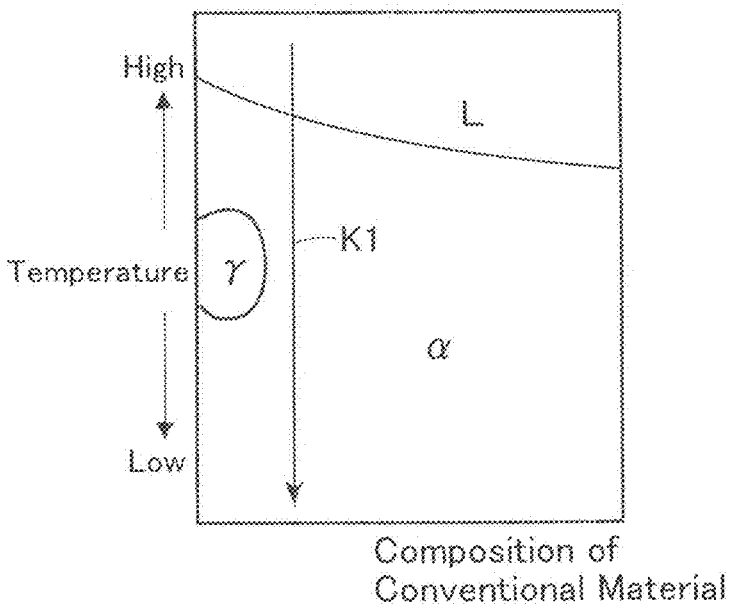
FIG. 10 is a view schematically showing the solidification condition of a conventional material.
Figure 11:
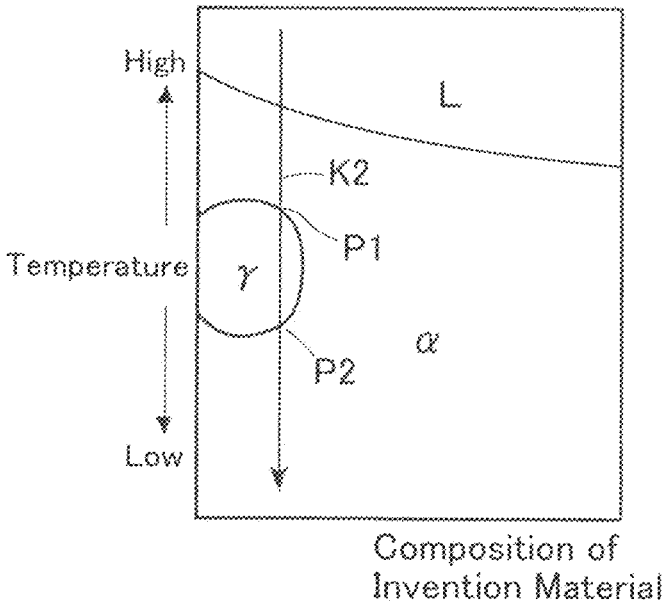
FIG. 11 is a view schematically showing the solidification condition of an invention material.

FIG. 10 is a solidification image of the conventional material, schematically showing the solidification process. FIG. 11 is a solidification image of the invention material, schematically showing the solidification process. The vertical axis of each graph in FIGS. 10 and 11 indicates the temperature and the horizontal axis indicates composition. The ferrite system of the conventional material shown in FIG. 10 includes very few or does not include nickel at all and accordingly, the austenite phase (γ) occupies a very narrow region. When molten metal (L; Liquid) is cooled down in an arrow K1 direction, the molten metal (L) produces the ferrite (α) without being transformed to the austenite phase (γ). Compared to this, according to the invention material shown in FIG. 11, nickel content is higher than that in the conventional material and the austenite phase ((γ) occupies a large region. In FIG. 11, when the molten metal (L; Liquid) is cooled down in an arrow K2 direction, the ferrite phase (α) is temporarily transformed to the austenite phase (γ) at the point P1. Thereafter, with cooling operation, the austenite phase (γ) is again transformed to the ferrite (α) at the point P2 and at the same time the alloy element having been entered into austenite solid solution is separated as the carbide to form the second phase.

EXAMPLE 4

Tables 4 and 5 are the examples which are believed to demonstrate the performance characteristic that is same level as the invention material based on the various experiments conducted by the inventor of this invention. These examples can produce the ferrite system heat-resistant cast steel which are inexpensive and are capable of improving reliability by largely improving the toughness under normal temperature and the thermal fatigue resistance. The test pieces Nos. 1B through 8B in Table 4 are the examples which can demonstrate the same or similar performance of the invention material. The examples Nos. 18 through 88 do not include vanadium. The test pieces Nos. 1C through 8C in Table 5 are the examples which can demonstrate the same or similar performance of the invention material. These examples Nos. 1C through 8C include vanadium with 4.8% or less, 0.30% or less or 0.20% or less.

TABLE 4

The compositions below can also secure the same level performances as the invention material.

| | No. | C % | Si % | Mn % | P % | S % | Cr % | Nb % | Al % | Ni % |
|---|---|---|---|---|---|---|---|---|---|---|
| Test Piece | 1B | 0.31 | 0.82 | 0.71 | 0.020 | 0.158 | 15.4 | 0.190 | 0.160 | 1.90 |
| Test Piece | 2B | 0.14 | 1.98 | 0.68 | 0.016 | 0.106 | 16.5 | 0.210 | 0.158 | 0.70 |
| Test Piece | 3B | 0.30 | 1.80 | 0.91 | 0.070 | 0.198 | 16.0 | 0.196 | 0.156 | 0.22 |
| Test Piece | 4B | 0.29 | 1.80 | 0.50 | 0.027 | 0.104 | 18.6 | 0.320 | 0.080 | 1.40 |
| Test Piece | 5B | 0.37 | 1.30 | 0.50 | 0.018 | 0.100 | 16.4 | 0.189 | 0.101 | 0.25 |
| Test Piece | 6B | 0.38 | 1.20 | 0.98 | 0.080 | 0.099 | 17.2 | 0.194 | 0.182 | 1.70 |
| Test Piece | 7B | 0.18 | 0.81 | 0.51 | 0.026 | 0.080 | 19.8 | 0.120 | 0.104 | 1.99 |
| Test Piece | 8B | 0.29 | 1.80 | 0.30 | 0.017 | 0.110 | 17.4 | 0.120 | 0.120 | 0.48 |

TABLE 5

The compositions below can also secure the same level performances as the invention material.

| | No. | C % | Si % | Mn % | P % | S % | Cr % | V % | Nb % | Al % | Ni % |
|---|---|---|---|---|---|---|---|---|---|---|---|
| Test Piece | 1C | 0.39 | 0.52 | 0.70 | 0.019 | 0.058 | 15.1 | 0.180 | 0.198 | 0.180 | 0.90 |
| Test Piece | 2C | 0.11 | 1.98 | 0.62 | 0.016 | 0.106 | 16.5 | 0.480 | 0.110 | 0.158 | 0.78 |
| Test Piece | 3C | 0.23 | 1.00 | 0.97 | 0.072 | 0.198 | 16.6 | 0.050 | 0.196 | 0.136 | 0.22 |
| Test Piece | 4C | 0.25 | 0.80 | 0.59 | 0.017 | 0.104 | 17.6 | 0.090 | 0.490 | 0.080 | 1.20 |
| Test Piece | 5C | 0.31 | 1.33 | 0.57 | 0.018 | 0.099 | 16.4 | 0.380 | 0.189 | 0.121 | 0.25 |
| Test Piece | 6C | 0.38 | 1.24 | 0.98 | 0.080 | 0.099 | 17.0 | 0.150 | 0.190 | 0.182 | 1.50 |
| Test Piece | 7C | 0.12 | 0.51 | 0.59 | 0.016 | 0.180 | 19.8 | 0.170 | 0.200 | 0.134 | 1.99 |
| Test Piece | 8C | 0.19 | 1.80 | 0.23 | 0.017 | 0.110 | 17.1 | 0.090 | 0.120 | 0.120 | 0.24 |

(Application)

Figure 12:
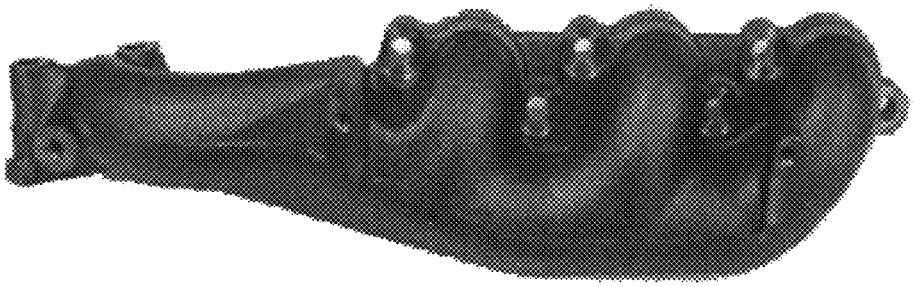
FIG. 12 is a photographic view showing an exhaust manifold.
Figure 13:
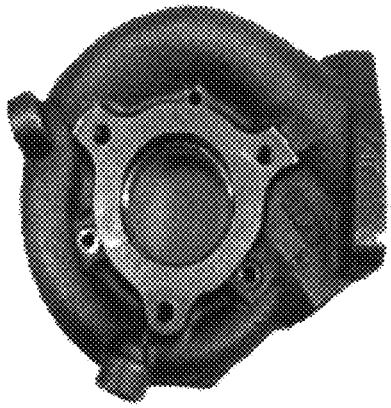
FIG. 13 is a photographic view showing a turbine housing.

As the use or application of the invention material, heat-resistant components are exampled. As the heat-resistant components, exhaust system components for use in automobiles or the industrial equipments can be exampled. As the exhaust system components, exhaust manifold (See FIG. 12), turbine housing (See FIG. 13) and turbine housing integrated exhaust manifold (FIG. 14) are exampled. In recent years, in the field of exhaust system component for automobile or industrial equipment, with the strengthening of the exhaust gas regulations, the exhaust gas temperature is becoming higher and higher, and 850° C. or more, 900° C. or more or even 950° C. or more temperature gases are now exhausted. In these exhaust system components, required thermal fatigue resistance is becoming higher and higher and this invention can be adapted to the materials used in such exhaust system components.

(Others)

The invention is not limited to the embodiments described above and indicated in the attached drawings. The embodiments can be arbitrarily modified and implemented without departing from the subject matter.

The invention claimed is:

1. A ferrite system heat-resistant cast steel including a ferrite system composition structure consisting of by percent by mass, 0.10% to 0.40% carbon, 0.5% to 2.0% silicon, 0.2% to 1.2% manganese, 0.3% or less phosphorus, 0.01% to 0.4% sulfur, 14.0% to 21.0% chrome, 0.05% to 0.6% niobium, 0.01% to 0.8% aluminum, 0.15% to 2.3% nickel, residual iron and inevitable impurities, wherein the ferrite system composition structure simultaneously includes a first phase formed by ferrite and a second phase formed by a phase in which carbide is mixed in the ferrite crystal grain, and wherein approximately 50% to approximately 80% of the ferrite system composition structure is formed of the second phase.

2. A ferrite system heat-resistant cast steel including a ferrite system composition structure consisting of, by percent by mass, 0.10% to 0.40% carbon, 0.5% to 2.0% silicon, 0.2% to 1.2% manganese, 0.3% or less phosphorus, 0.01% to 0.4% sulfur, 14.0% to 21.0% chrome, 0.01% to 0.5% vanadium, 0.05% to 0.6% niobium, 0.01% to 0.8% aluminum, 1.01% to 2.3% nickel, residual iron and inevitable impurities, wherein the ferrite system composition structure simultaneously includes a first phase formed by ferrite and a second phase formed by a phase in which carbide is mixed in the ferrite crystal grain, and wherein approximately 50% to approximatel 80% of the ferrite system composition structure is formed of the second phase.

3. The ferrite system heat-resistant cast steel according to claim 1, wherein the ferrite system heat-resistant cast steel exhibits an elongation performance is 4% or more and a tensile strength is 400 MPa or more.

4. The ferrite system heat-resistant cast steel according to claim 1, wherein the ferrite system heat-resistant cast steel having been subjected to a heat treatment conducted by the steps of heating and holding with the temperature of between 800° C. and 970° C., and thereafter cooling down to the temperature of 700° C. or less.

5. The exhaust system component formed by the ferrite system heat-resistant cast steel according to claim 1.

6. The ferrite system heat-resistant cast steel of claim 1, wherein approximately 55% to approximately 75% of the ferrite system composition structure is formed of the second phase.

7. The ferrite system heat-resistant cast steel of claim 2, wherein approximately 55% to approximately 75% of the ferrite system composition structure is formed of the second phase.

* * * * *